US009700926B2

(12) United States Patent
Codatto

(10) Patent No.: US 9,700,926 B2
(45) Date of Patent: Jul. 11, 2017

(54) INDUSTRIAL MACHINE FOR BENDING METALLIC FLAT ELEMENTS

(71) Applicant: TRUMPF Maschinen Austria GmbH & Co. KG., Pasching (AT)

(72) Inventor: Antonio Codatto, Lonigo (IT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 510 days.

(21) Appl. No.: 14/367,360

(22) PCT Filed: Dec. 20, 2012

(86) PCT No.: PCT/IT2012/000392
§ 371 (c)(1),
(2) Date: Jun. 20, 2014

(87) PCT Pub. No.: WO2013/093950
PCT Pub. Date: Jun. 27, 2013

(65) Prior Publication Data

US 2014/0338417 A1 Nov. 20, 2014

(30) Foreign Application Priority Data

Dec. 22, 2011 (IT) ..... VI2011A0331

(51) Int. Cl.
*B21D 5/04* (2006.01)
*B21D 11/22* (2006.01)
(Continued)

(52) U.S. Cl.
CPC ..... *B21D 5/04* (2013.01); *B21D 5/002* (2013.01); *B21D 5/02* (2013.01); *B21D 5/045* (2013.01); *B21D 11/22* (2013.01); *B21D 43/26* (2013.01)

(58) Field of Classification Search
CPC ..... B21D 5/045; B21D 5/02; B21D 5/002; B21D 43/26; B21D 11/22; B21D 5/04
(Continued)

(56) References Cited

U.S. PATENT DOCUMENTS 3,826,119 A * 7/1974 Marotto ..... B21D 11/22 72/31.01
4,192,168 A * 3/1980 Di Ciaccio ..... B21D 5/002 72/389.3
(Continued)

FOREIGN PATENT DOCUMENTS

EP 1410855 A1 4/2004
EP 1797973 A1 6/2007
(Continued)

OTHER PUBLICATIONS

International Search Report Dated Mar. 25, 2013.

*Primary Examiner* — David B Jones
(74) *Attorney, Agent, or Firm* — Collard & Roe, P.C.

(57) ABSTRACT

An industrial machine (1) for bending metallic flat elements (E) comprising a support framework (2) which insists on a reference surface (T), a working plan (3), connected to the support framework (2) and accessible to the operator, adapted to receive the metallic flat element (E) to be folded, bending means (4), arranged frontally to the working plan (3) and coupled to the support frame (2), suitable to bend upwards and/or downwards at least one side edge of the metallic flat element (E), handling and supply means (5), operatively connected to the working plan (3), suitable for supplying/removing the metallic flat element (E) to/from the bending means (4), and actuation means (6), operatively connected to the handling and supply means (5) to move them along a vertical direction (Y) and/or horizontal direction (X) determining the displacement with respect to the working plan (3).

10 Claims, 11 Drawing Sheets

Figure 1:
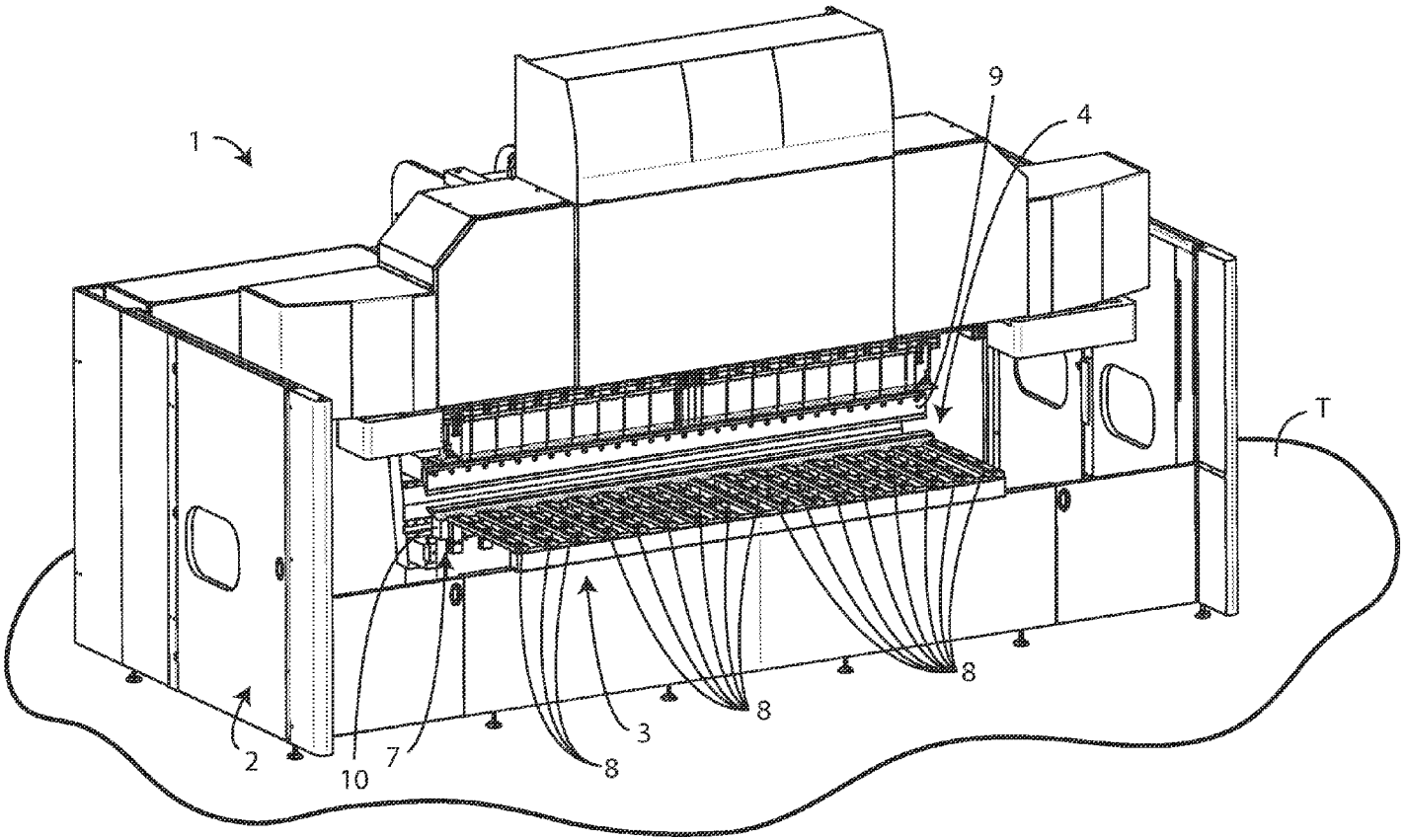
Figure 2:
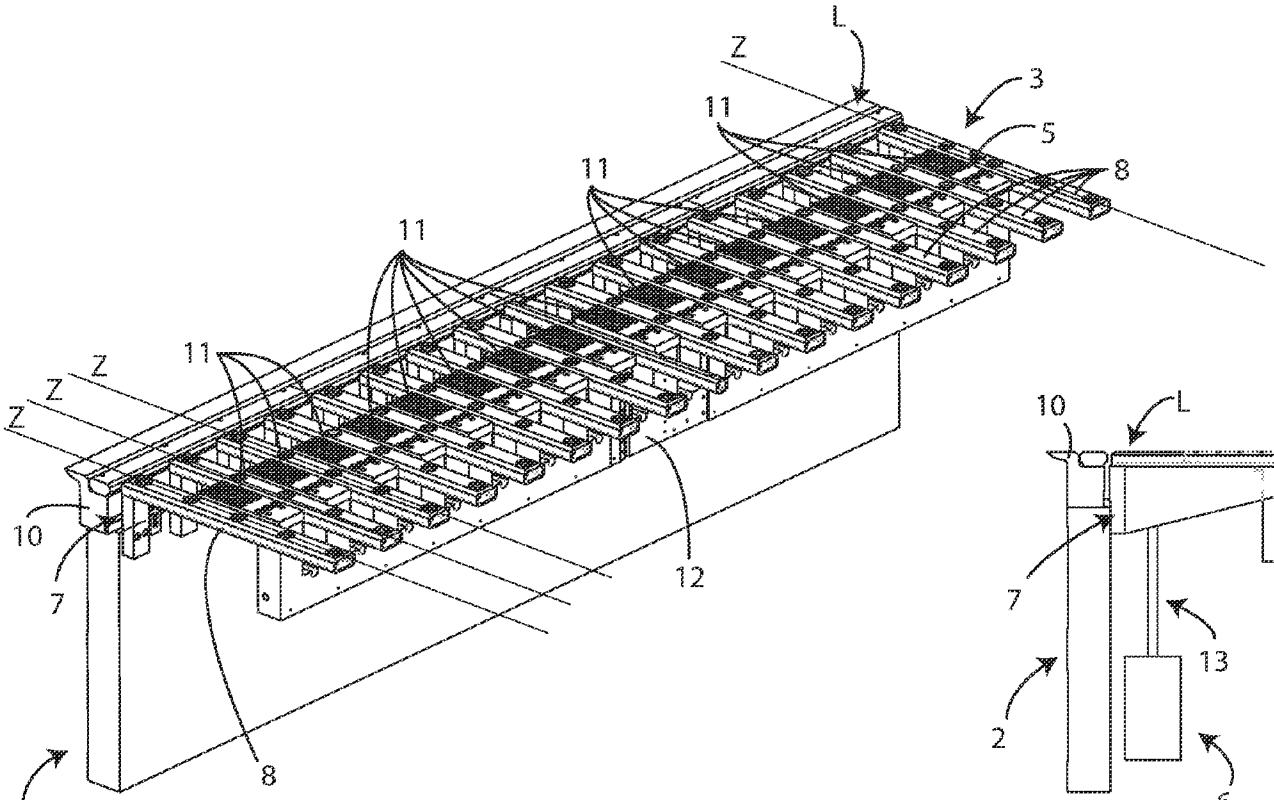
Figure 2A:
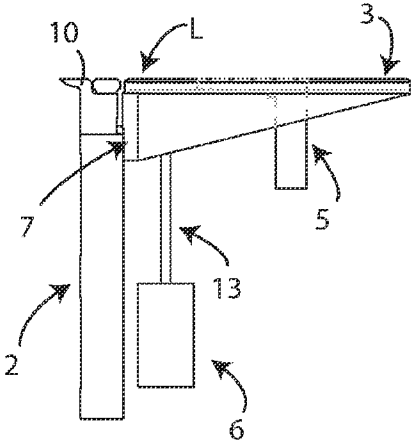
Figure 3A:
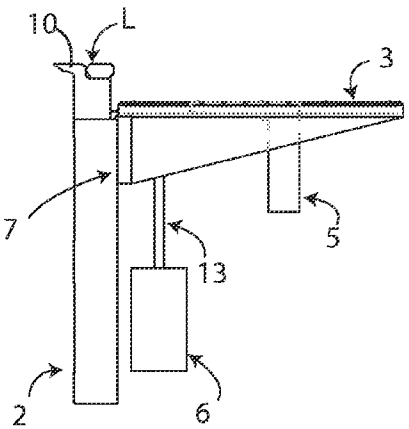
Figure 3:
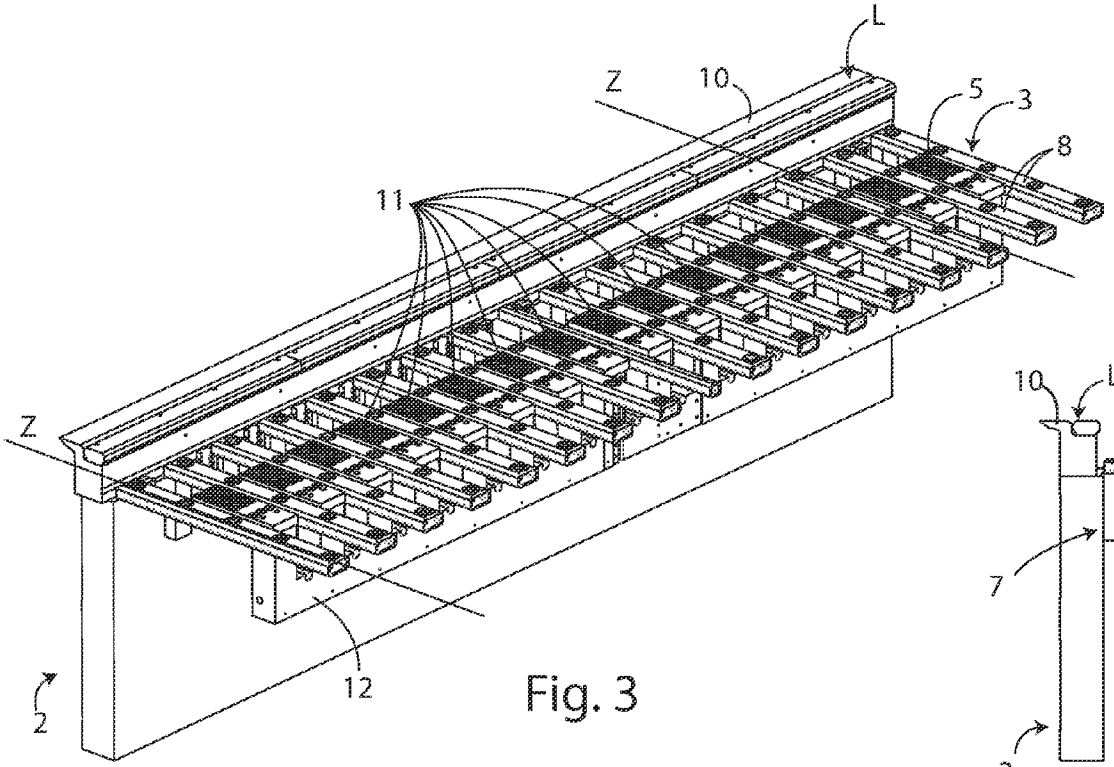
Figure 4A:
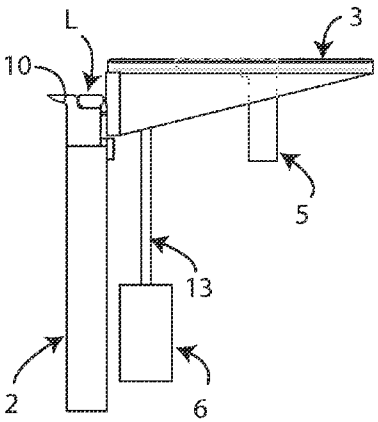
Figure 4:
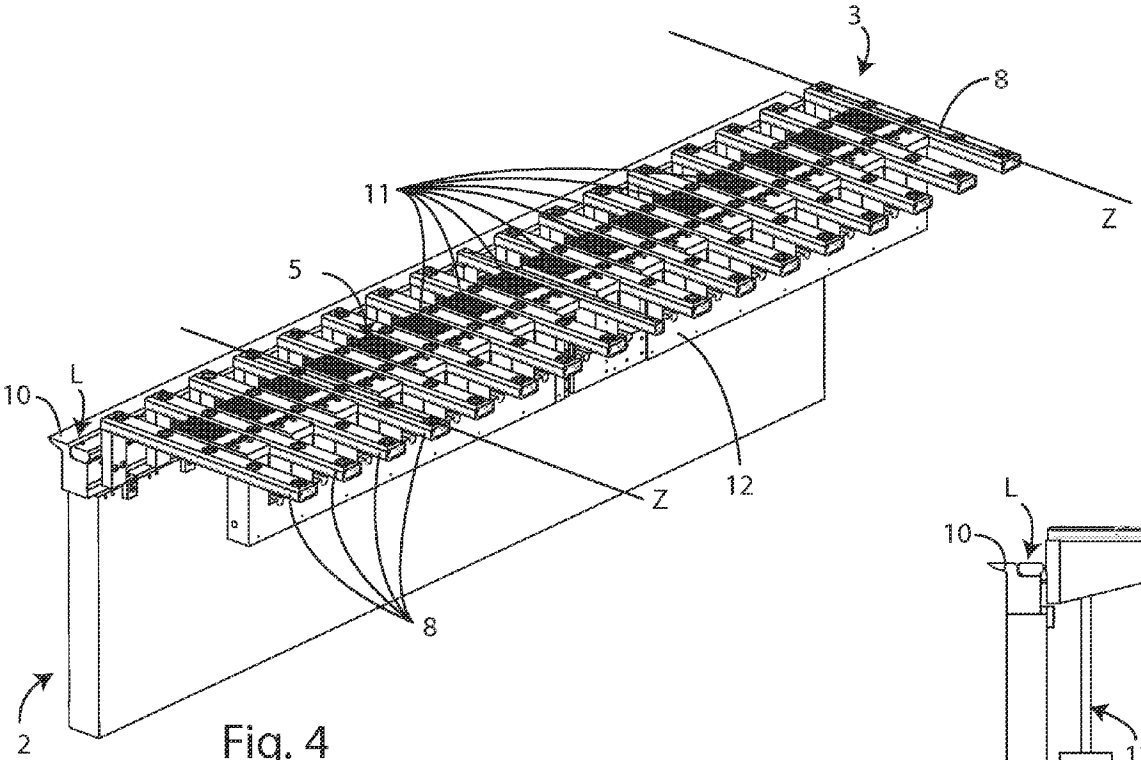
Figure 5A:
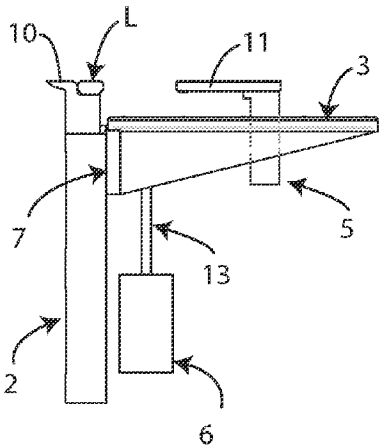
Figure 5:
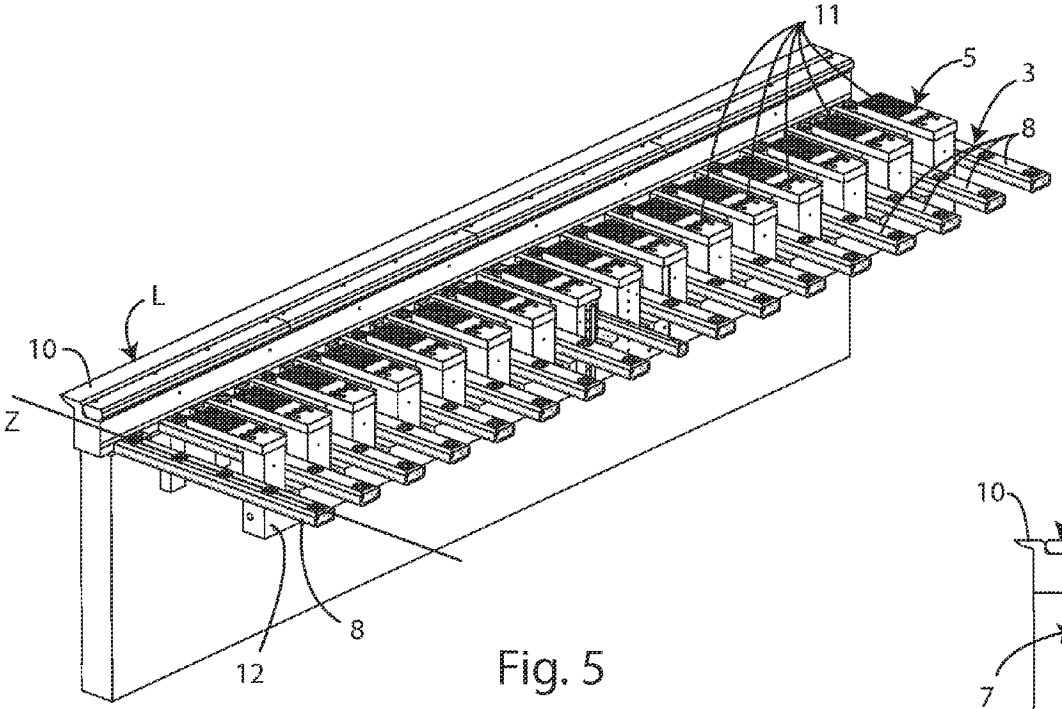
Figure 6:
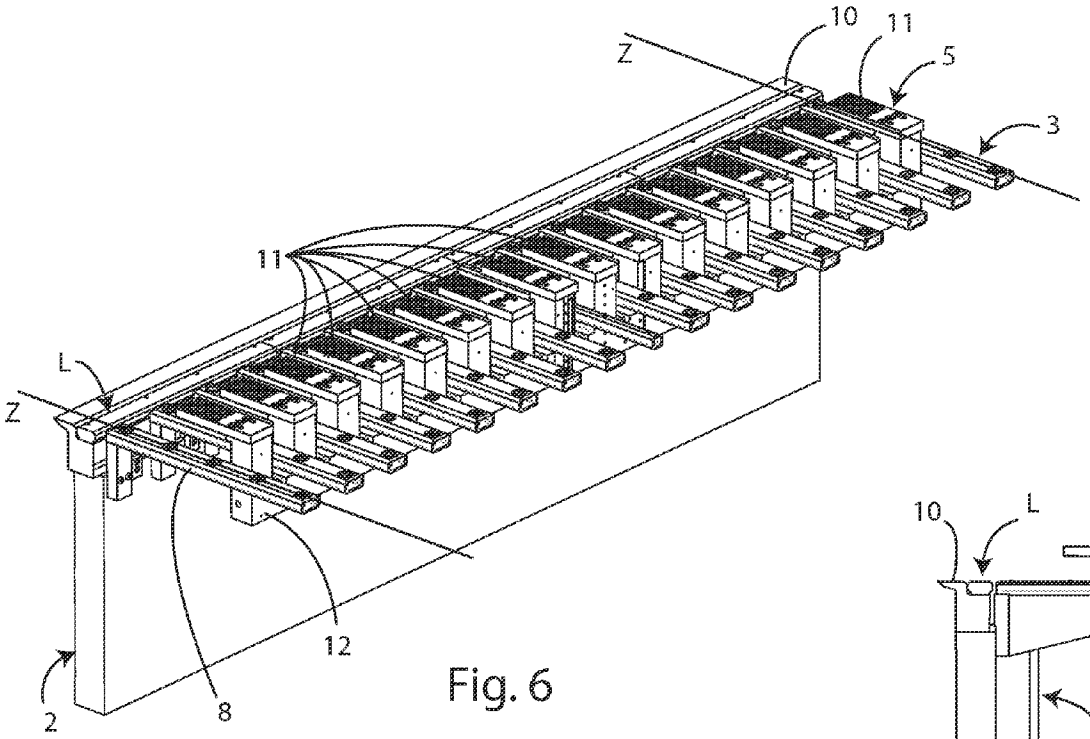
Figure 6A:
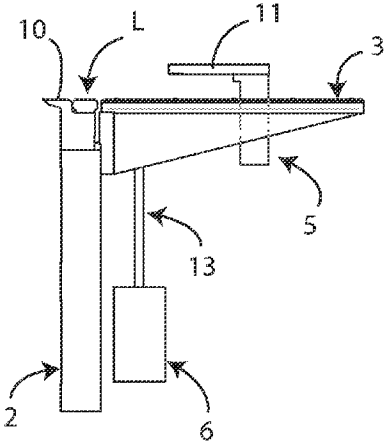

(51) Int. Cl.
*B21D 5/00* (2006.01)
*B21D 43/26* (2006.01)
*B21D 5/02* (2006.01)

(58) Field of Classification Search
USPC ..... 72/426
See application file for complete search history.

(56) References Cited

U.S. PATENT DOCUMENTS 4,411,150 A * 10/1983 Klein ..... B21D 43/26 72/389.3
5,501,095 A * 3/1996 Dilger ..... B21D 43/26 72/31.1
5,765,427 A 6/1998 Codatto
6,185,974 B1 2/2001 Venturini
6,212,933 B1 * 4/2001 Aoki ..... B21D 5/002 72/389.3
6,269,677 B1 * 8/2001 Torvinen ..... B21D 5/002 72/16.2
7,055,355 B2 6/2006 Codatto
7,260,974 B2 * 8/2007 Koch ..... B21D 5/02 72/31.12
2008/0072648 A1 3/2008 Kutschker
2008/0216545 A1 9/2008 Codatto
2014/0338417 A1 * 11/2014 Codatto ..... B21D 5/045 72/426

FOREIGN PATENT DOCUMENTS

EP 1 905 522 A1 4/2008
EP 1967300 A2 9/2008
JP 2000-042662 A 2/2000
JP 2000-126818 A 5/2000
JP 2000-237822 A 9/2000

* cited by examiner

INDUSTRIAL MACHINE FOR BENDING METALLIC FLAT ELEMENTS

The present invention relates to an industrial machine for bending (also known as folding) metallic flat elements, typically panels, metal sheets, plates and similar, for obtaining shaped elements according to a predetermined pattern.

As known and generally, an industrial machine for bending deformable metallic flat elements, such as sheet metal, slab or plates, belongs to an articulated and complex automated system which, in addition to it, also includes a loading station which receives the flat metallic element to be bent, an unloading station which receives the bent flat metallic element and a translating unit adapted to move between the different stations the flat metallic element to be bent or folded.

The loading station, the industrial machine for bending and the unloading station are essentially arranged one in series (or in-line) to the other, with the bending machine interposed between the loading station and the unloading station.

More precisely, a typical industrial machine of known type for bending metallic flat elements comprises, in the main and essential units, a supporting framework, which insists on a reference surface (for example, the floor of an industrial plant), and a worktop, connected to the supporting framework and accessible to the operator, which receives the metallic flat element to bend.

The industrial machine of known type in question also comprises, folding means (including the so-called upper and awards prizes-sheet-lower sheet), arranged frontally to the working plan and coupled to the support framework, acting to bend upwards and/or downwards at least one side edge of such metallic flat element.

In addition, this industrial machine comprises means for gripping and feeding, operatively connected to the working plan, suitable for supplying/removing the metallic flat element to/from the folding means, as well as actuation means—usually suction cup means—operatively connected to the handling and supply means to move them along a vertical direction and/or horizontal direction by determining the displacement with respect to the working plan.

An industrial machine structured as the one above mentioned succeeds in allowing the design and efficient implementation of a wide variety of folds on the metallic flat element.

However, also the industrial machine for bending metallic flat elements just summarily described presents some recognized drawbacks, encountered especially in cases in which the metallic flat elements to be bent are particularly heavy and wide and provide a series of folds rather deep, complex (different, for example, from the simplest C shaped folds) and/or in large number as more and more required by the needs of the market.

Indeed, for these specific metallic flat elements, it is currently necessary to provide that the working plan includes a bearing surface partially flexible and resilient so that the already bent part of the metallic flat elements themselves, consisting for example of at least one peripheral side edge, can conveniently and slightly seep into the interior of the support framework itself so that the metallic flat elements continue to assume the correct position perfectly horizontal when they are arranged on the second working plan along with a spatial orientation which differs from that taken during the previous fold to which they were subjected, in order to undergo a further, distinct and subsequent fold.

Typically, the flexibility of the support framework of the metallic elements is ensured by providing as a working plan a series of shaped sections arranged side by side, spaced and parallel, each of which is provided on the top of a close series of bristles or brushes protruding (known also with the term "brushes" in the jargon of the trade).

In any case, a working plan of the type known as "brushes", however effective, is only suitable for machining of bent metallic flat elements with minimum negative dimensions (ie downward), because, in the presence of:

- bulky, heavy and/or of considerable dimensions (width and/or length) metallic flat elements;
- negative rather complex folds, articulated, evident and/or deep performed on the metallic elements to be bent;
- negative rather numerous folds, furthermore if consecutive between one each other on the same strectch, performed on the metallic flat element to be bent, toothbrushes themselves hinder, even appreciably, the correct penetration within them of the folded parts of the metallic elements, since the folds of the metallic flat elements are variously shaped and articulated, as well as the easy and quick handling of the latter on the working plan at the end of an operation of folding, since the metallic flat elements crush excessively the toothbrushes (bristles or brushes).

As a consequence of matter, on the one hand, when at least one of their peripheral edges has already undergone a fold, the above metallic flat elements previously identified are not always able to take on the working plan "in toothbrushes" the horizontal position, the correct one for a subsequent operation of bending of another peripheral edge, with the inevitable penalizing consequence that the known bending machines are often unsuitable to perform additional folds of certain types of metallic flat elements already bent, to the point that such additional folds are discarded beforehand.

On the other hand, the handling operations of the metallic flat elements on the working plan "to toothbrushes" become rather complex and complicated and automatically impossible, requiring the necessary and prolonged intervention of an operator, with all the economic disadvantages and the resulting operational and that are clearly understandable.

The present invention intends to overcome the drawbacks of the prior art just highlighted In particular, primary purpose of the invention is to devise an industrial machine brake which will extend beyond the state of the art the range of folds effectively executable to the metallic flat elements commonly recognized as most heavy, bulky and/or complex to manufacture by number and type of folds on them provided.

In other words, the main object of the present invention is to provide an industrial machine for bending especially of metallic flat elements more complicated to work for weight, size, number and complexity of folds provided for, which is able to operate with greater effectiveness and efficiency compared to the equivalent machines of the known type.

Within this aim, it is, therefore, task of the invention realize an industrial machine for bending metallic flat elements that allow to fulfill the requirements of the pertinent market to a greater extent than the known art.

It is a second task of the present invention to develop an industrial bending machine that is usable to bend almost any metallic flat elements. It is a second aim of the present invention to provide with an industrial machine for bending metallic flat elements that allows to automize the handling operations of the metallic flat elements equipped with a high number of folds, also complex and articulated, already performed.

Within this second purpose, taking into account the current state of art it is task of the invention to limit the number of actions of an operator moving metallic flat elements already partially folded in order to place them in new and correct position preceding an operation of bending.

It is another task of the invention to optimize the management of human resources related to operations and management of an industrial machine for bending metallic flat elements.

Last, but not least it is aim of the invention to provide an industrial machine which allows to reduce, compared to the current state of the art, the cost and the time for the processing of metallic flat elements, such as sheets, plates, panels and similar, particularly critical and complicated to handle during the bending steps.

The foregoing objects are achieved by an industrial machine for bending metallic flat elements according to claim 1 attached hereto, which reference is made for brevity of exposure.

Further technical features of detail of the industrial machine of the invention are contained in the corresponding dependent claims.

Advantageously, the bending industrial machine object of the invention allows to considerably expand—compared to the state of the art—the range of folds which are effectively executable on metallic flat elements notoriously considered more heavy, bulky (especially in the dimension of the width and length) and/or complex to be carried out by number and type of folds on in them.

This is due to the fact that, in an innovative way in the relevant field, the working plan, together with the handling and supply means, is made vertically movable with respect to the support framework to which it is connected.

This allows metallic flat element, already folded in one or more points or edges, to be raised beyond the working plan once the fold has been made and to be freely and easily moved to assume, always on the working plan, a new orientation useful for execution of a further and distinct fold or to be definitively removed and collected by the operator.

Dealing with what has just been said, the industrial machine of the invention allows to bend even with multiple steps of perimeter edges or distinct internal strengthes and any other metallic flat elements.

Equally advantageously, the industrial machine for blending metallic flat elements object of the invention allows to satisfy in a more specific way, easier and quicker compared to the prior art, a wider variety of demands from the market.

Still advantageously, using the industrial machine for blending of the invention it is possible to automate effectively handling operations of the metallic flat elements equipped with a high number of folds also complex and articulated already performed, thus limiting the interventions of the operator who is, therefore, freely and properly assignable to other tasks.

Advantageously, furthermore, the invention reduces, compared to the prior art, costs and time for the machining of metallic flat elements particularly critical and complicated (because of weight, size, number and articulation of the folds provided) to be handled during the folding steps.

The aims and advantages described above, as well as others that will emerge later, will be best understood from the following description, relating to a preferred embodiment of the industrial machine of the invention, which represents an indicative and illustrative, but not limitative, example, with the support of the enclosed drawings, wherein:

- FIG. 1 is a simplified isometric view of the industrial machine of the invention;
- FIGS. 2-6 are different isometric views of the industrial machine of FIG. 1 in five different operating conditions;
- FIGS. 2*a*-6*a* are different side views of the respective FIGS. 2-6;
- FIGS. 7-11 are schematic side views of the separate machine of FIG. 1, corresponding to the five respective operating conditions of FIGS. 2-6, which show some phases of bending of the metallic flat elements.

The industrial machine for bending metallic flat elements lans, such as a sheet, is illustrated in FIG. 1 where it is globally numbered with 1. For simplicity and convenience, the above mentioned metallic flat element to be bent is only visible to FIGS. 8 and 10 where it is indicated with E. As visible, the industrial machine 1 includes:

- A support framework 2 which insists on a reference surface T, typically the paving of an industrial plant;
- A working plan 3, connected to the support framework 2 and accessible to the operator, adapted to receive the metallic flat element E to be bent;
- Bending means, overall indicated with 4, arranged frontally to the working plan 3 and coupled to the support framework 2, suitable to bend upwards and/or downwards at least one side edge of the metallic flat element E;
- Gripping means and power, as a whole numbered with 5, operatively connected to the work surface 3 and suitable for supplying/removing the metal element E plane to/from the folding means 4;
- Actuation means, generally indicated with 6 and operatively connected to the handling and supply means 5 to move them along a vertical direction Y and/or horizontal direction X determining the displacement with respect to the working plan 3.

In accordance with the invention, the working plan 3 is vertically movable being coupled to the support framework 2 by means of guide means, schematically indicated with 7, and operatively connected to the actuation means 6 that the animate along the vertical direction Y for place it below and/or above the bending level L of the metallic flat element E. Substantially, therefore, the working plan 3 is functionally independent and separate from the gripping means and supply 5. Preferably but not necessarily, the working plan 3 is vertically movable with linear excursion C whose value is not more than 350 mm: this linear excursion C of the working plan 3 allows handling in an automatic way with effectiveness, convenience and accuracy any metallic flat elements and already folded.

As a pure example, the value of the excursion or linear excursion C (clearly visible in FIG. 9) of the working plan 3 is in the range −10 (negative folds of the metallic plane E)÷+130 mm (folds positive of the metallic flat element E) compared to the bending level L considered as the zero point reference.

In any case, the value of the excursion or stroke linear C depends on the practical needs of the customer.

As shown in FIGS. 1-6, the working plan 3 comprises, in a preferred but not binding structure, a plurality of bearing section bars 8 are mutually spaced and separated, individuating linear directions Z substantially parallel to each other.

More precisely, bearing section bars 8 protrude in this case cantilevered from the support framework 2 which are stably coupled. In this regard, it is noted that, preferably, bearing section bars 8 are removably coupled to the support framework 2.

More in detail, each of the bearing section bars 8 presents in a transverse section a substantially L-shaped profile which, in the application conditions of the bearing section bars 8 themselves, appears rotated 90° clockwise. As regards the bending means 4, they are of a kind known per se to the person skilled in the art, comprising essentially a mobile upper press-plate (9) and a mobile lower press-plate 10 fixed, which precisely determines the bending level L.

With reference to the handling and supply means 5, they include, by way of preferred but not exclusive structure, a plurality of suction cups organs 11, each of which is interposed between a pair of bearing section bars 8 adjacent one each other and coupled to a support longitudinal member 12 which makes them perfectly integral with each other during the vertical and horizontal movement imparted by the actuation means 6. Appropriately and conveniently, the actuation means 6 are of the automatic type which are arranged below the working plan 3. According to the preferred embodiment described herein the invention, the actuation means 6 comprise moving means, signed with 13, suitable for actuating independently the working plan 3 and the handling and supply means 5.

In other embodiments of the invention, not illustrated in the drawings that follow, the actuation means may comprise first movement means suitable for actuating the handling and supply means, and second moving means, different from the first moving means, suitable for operating said working plan.

The movement means 13 comprise any of the actuating members selected from the group consisting of hydraulic actuators, pneumatic actuators, electric motors, mechanisms of electromagnetism and so on.

The operation of the industrial machine 1 for bending metallic flat elements it is well depicted in FIGS. 2-6 and in the respective details 2*a* to 6*a*, as well as in a more clear and specific in FIGS. 7-11 which indicate, among other things, the height H of the bending level L.

Figure 7:
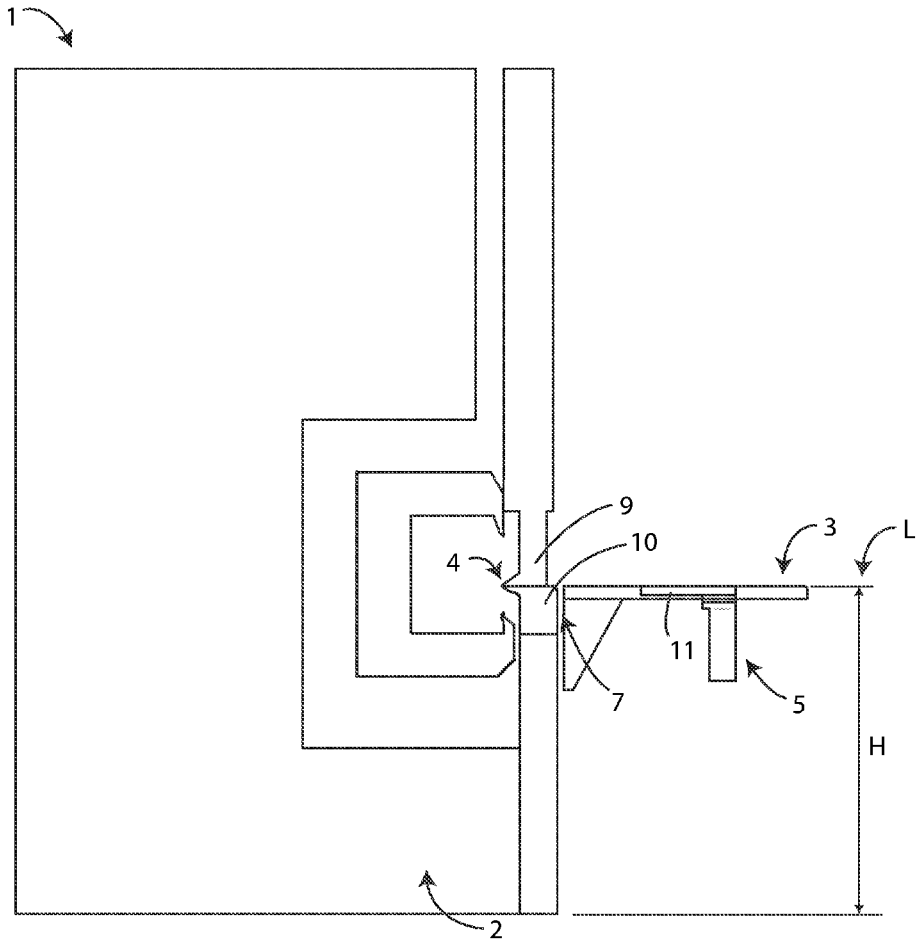

In particular, FIG. 7 shows the working plan 3 and the handling and supply means 5 arranged by common actuation means 6 the height H of the bending level L.

Figure 8:
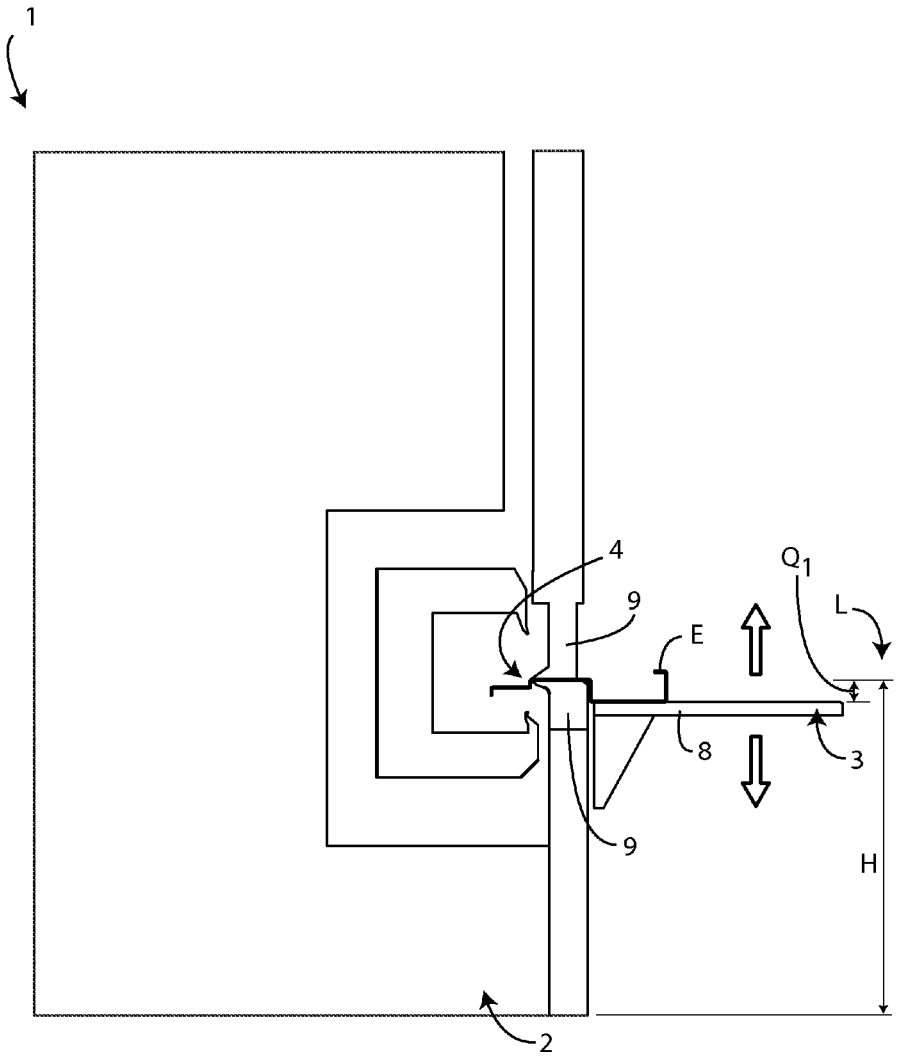

In the subsequent FIG. 8, the actuation means 6 lowers the working plan 3 of a share Q1, having for example a value of 10 mm, so as to compensate the fold already performed on the metallic flat elements E and projecting externally to the bending means 4: so the part to be bent of the metallic flat elements E remains perfectly in the correct horizontal position. In this phase, the suction cups organs 11 of the handling and supply means 5 remain at the blending level L, so that their upper surface is coplanar to the upper wall of the lower press-plane 10.

Figure 9:
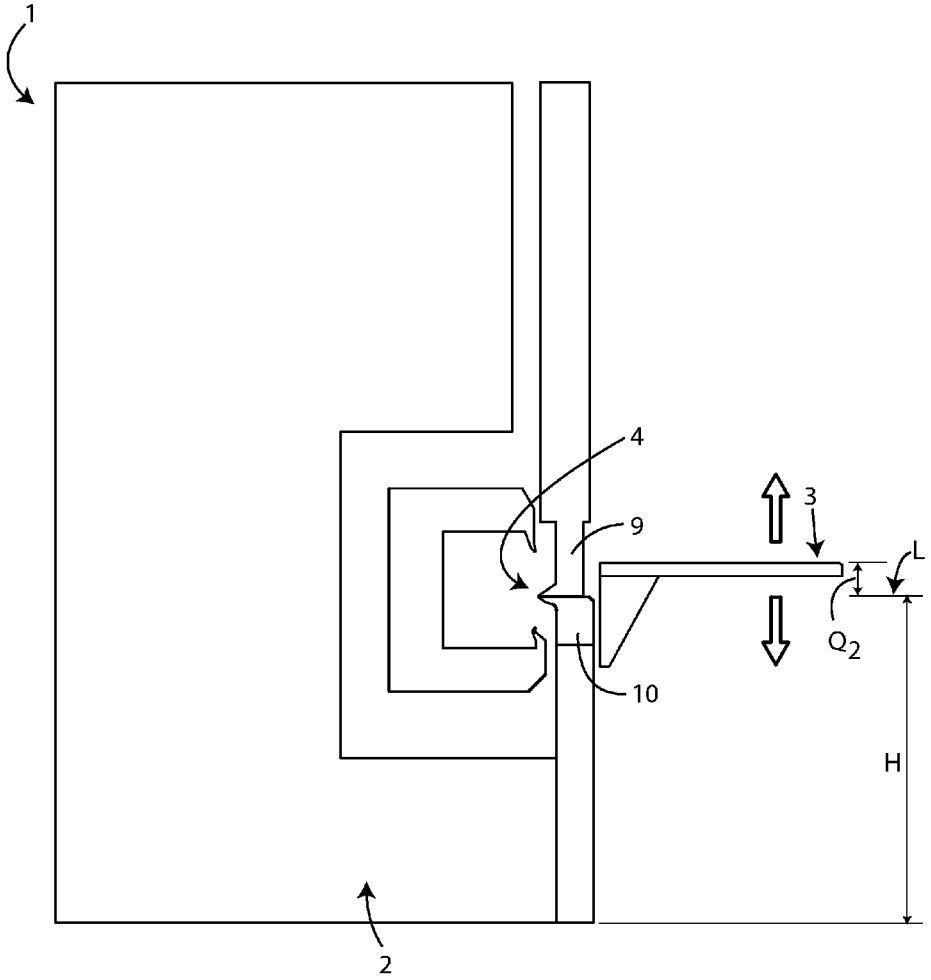

Next FIG. 9 shows the working plan 3 brought by actuation means 6 beyond the blending level L, with respect to which is located at an altitude Q2, having for example a value of 130 mm so that the overall vertical stroke, low from the position of FIG. 8, is equal to 140 mm.

Figure 10:
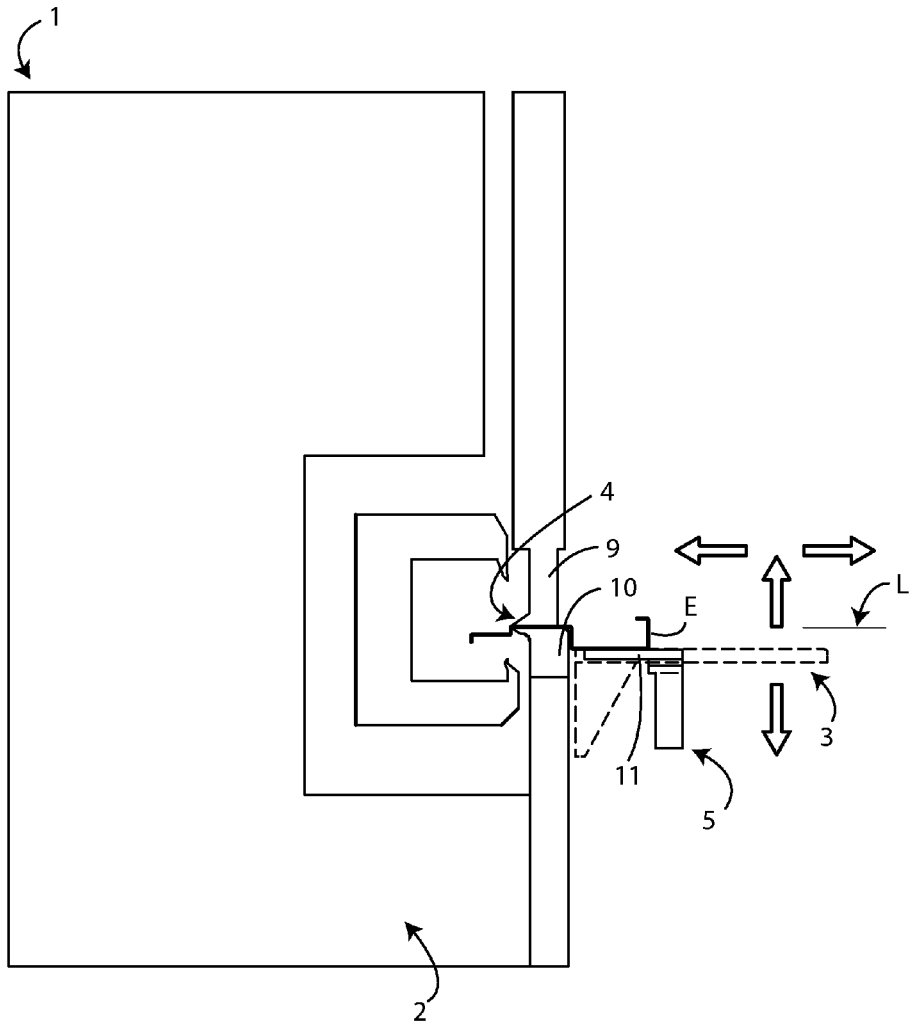
Figure 11:
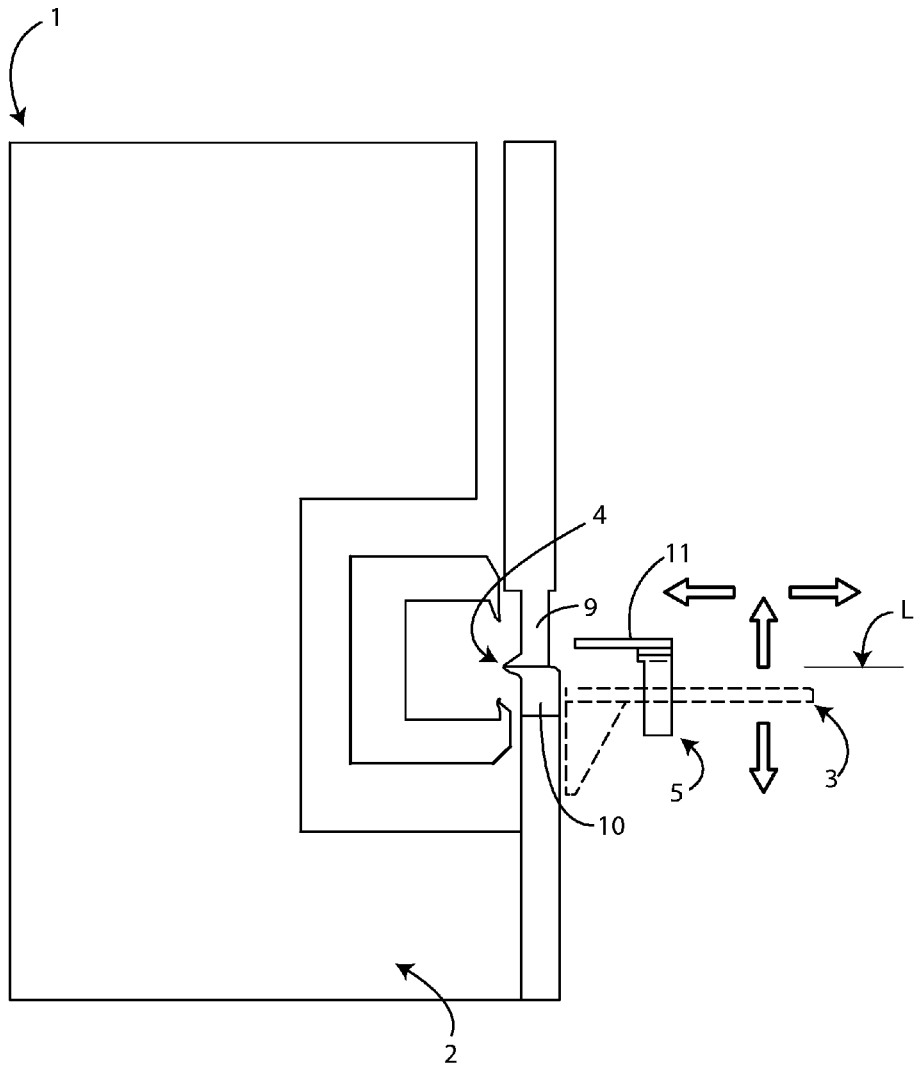

Finally, the subsequent FIGS. 10 and 11 show handling and supply means 5, in this case, the suction cups organs 11, respectively below and above the blending level L, moved by actuation means 6 independently and autonomously with respect to the working plan 3 (which in these FIGS. 10 and 11 is drawn dashed).

According to the description above mentioned, it is understood, therefore, that the industrial machine for bending metallic flat elements object of the invention achieves the aims and realizes the advantages previously mentioned.

Durung the execution step, the industrial machine object of the invention may undergo further changes compared to those already shown and consisting, for example, in a support framework different from the one shown in the following figures and only summarily described above.

Furthermore, in other embodiments of the invention, not illustrated below, the actuation means may be of a type different from those indicated in the previous description.

In addition, further embodiments of the industrial machine claimed herein, not shown, may include handling and supply means other than those on which was based the description of the preferred embodiment of the invention, which does not affect the main advantages and innovative subtended to the latter.

In addition, the mobile working plan of the industrial machine of the invention may take other constructive composition in other construction variants of the invention, yet not shown.

Other executions of the industrial machine of the invention, yet not illustrated in the attached drawings, will be able to provide that the actuation means move the handling and supply means only along a vertical direction or only along an horizontal direction in order to determine the displacement relative to the working plan.

Finally, alternative executions of the invention may exist, even if not shown in the attached drawings, in which the means of bending the metallic flat element have a different composition from that one obtainable from these drawings.

It is clear, finally, that numerous other variations may be made to the industrial machine in question, without differting from the principles of novelty inherent in the inventive idea expressed here, as it is clear that, in the practical embodiment of the invention, the materials, the shapes and dimensions of the illustrated details can be any, depending on requirements, and be replaced with other technically equivalent. Where the construction features and the techniques mentioned in the subsequent claims are followed by reference numbers or signs, those reference signs have been introduced with the sole purpose of increasing the intelligibility of the claims themselves and, consequently, they have no limiting effect the interpretation of each element identified by way of example only, by such reference signs.

The invention claimed is:

1. Industrial machine for bending a metallic flat element comprising a side edge, the industrial machine comprising:

a support framework configured to stand on a reference surface and extend upwardly from said reference surface;

a working deck connected with said support framework and configured to receive said metallic flat element;

a bending device arranged in front of said working deck, coupled with said support framework, and configured to bend the side edge of said metallic flat element upwardly, downwardly, or upwardly and downwardly;

a handling and supply device operatively connected with said working deck, configured to supply/remove said flat metallic element to/from said bending device, and comprising at least one gripper;

an actuator operatively connected with said handling and supply device in order to move the handling and supply device along a vertical direction and/or a horizontal direction determining displacement with respect to said working deck; and a guide;

wherein said working deck is movable vertically via said guide while being coupled with said support framework;

wherein said working deck is operatively connected with said actuator such that said actuator is configured to move said working deck along said vertical direction in order to place said working deck below and/or above a bending level of said flat metallic element;

wherein said working deck includes a plurality of bearing section bars spaced apart and separated from each other, the bearing section bars extending in a linear direction substantially parallel to each other; and wherein said bearing section bars protrude cantilever from said support framework.

2. Machine according to claim 1, wherein said working deck is functionally independent and distinct from said handling and supply device.

3. Machine according to claim 1, wherein said working deck is movable vertically with a linear excursion whose value is not greater than 350 mm.

4. Machine according to claim 1, wherein each of said bearing section bars presents in cross section a substantially L-shaped profile, and wherein in application conditions of said bearing section bars, said substantially L-shaped profile appears rotated 90°clockwise.

5. Machine according to claim 1, wherein said actuator is an automatic type and is disposed below said working deck.

6. Machine according to claim 1, wherein said actuator comprises a moving device configured to independently operate said working deck and said handling and supply device.

7. Machine according to claim 1, wherein said actuator includes:

a first moving device configured to operate said handling and supply device, and a second moving device distinct from said first moving device and configured to operate said working deck.

8. Machine according to claim 6, wherein said moving device includes an actuating organ selected from the group consisting of a hydraulic actuator, a pneumatic actuator, an electric motor, and an electromagnetism mechanism.

9. Industrial machine for bending a metallic flat comprising a side edge, the industrial machine comprising:

a support framework configured to stand on a reference surface and extend upwardly from said reference surface;

a working deck connected with said support framework and configured to receive said metallic flat element;

a bending device arranged in front of said working deck, coupled with said support framework, and configured to bend the side edge of said metallic flat element upwardly, downwardly, or upwardly and downwardly;

a handling and supply device operatively connected with said working deck, configured to supply/remove said flat metallic element to/from said bending device, and comprising at least one gripper;

an actuator operatively connected with said handling and supply device in order to move the handling and supply device along a vertical direction and/or a horizontal direction determining displacement with respect to said working deck; and a guide;

wherein said working deck is movable vertically via said guide while being coupled with said support framework;

wherein said working deck is operatively connected with said actuator such that said actuator is configured to move said working deck along said vertical direction in order to place said working deck below and/or above a bending level of said flat metallic element;

wherein said working deck includes a plurality of bearing section bars spaced apart and separated from each other, the bearing . section bars extending in a linear direction substantially parallel to each other; and wherein said bearing section bars are removably coupled with said support framework.

10. Industrial machine for bending a metallic flat comprising a side edge, the industrial machine comprising:

a support framework configured to stand on a reference surface and extend upwardly from said reference surface;

a working deck connected with said support framework and configured to receive said metallic flat element;

a bending device arranged in front of said working deck, coupled with said support framework, and configured to bend the side edge of said metallic flat element upwardly, downwardly, or upwardly and downwardly;

a handling and supply device operatively connected with said working deck, configured to supply/remove said flat metallic element to/from said bending device, and comprising at least one gripper;

an actuator operatively connected with said handling and supply device in order to move the handling and supply device along a vertical direction and/or a horizontal direction determining displacement with respect to said working deck; and a guide;

wherein said working deck is movable vertically via said guide while being coupled with said support framework;

wherein said working deck is operatively connected with said actuator such that said actuator is configured to move said working deck along said vertical direction in order to place said working deck below and/or above a bending level of said flat metallic element;

wherein said working deck includes a plurality of bearing section bars spaced apart and separated from each other, the bearing section bars extending in a linear direction substantially parallel to each other;

wherein said working deck includes a support longitudinal member, the bearing section bars being coupled with the support longitudinal member; and wherein said gripper includes a plurality of suction cups organs, each of said suction cup organs being interposed between a pair of said bearing section bars disposed adjacent each other.

* * * * *